US012560348B2

(12) United States Patent
Baba et al.

(10) Patent No.: US 12,560,348 B2
(45) Date of Patent: Feb. 24, 2026

(54) AIR CONDITIONER

(71) Applicant: Carrier Japan Corporation, Tokyo (JP)

(72) Inventors: Atsushi Baba, Fuji (JP); Masaaki Sato, Fuji (JP); Hiroichi Yamaguchi, Fuji (JP); Yukio Kiguchi, Fuji (JP); Kohei Maruko, Fuji (JP); Shohei Arita, Fuji (JP)

(73) Assignee: Carrier Japan Corporation, Tokyo (JP)

( * ) Notice: Subject to any disclaimer, the term of this patent is extended or adjusted under 35 U.S.C. 154(b) by 40 days.

(21) Appl. No.: 18/471,539

(22) Filed: Sep. 21, 2023

(65) Prior Publication Data

US 2024/0011662 A1 Jan. 11, 2024

Related U.S. Application Data

(63) Continuation of application No. PCT/JP2022/000242, filed on Jan. 6, 2022.

(30) Foreign Application Priority Data

Mar. 22, 2021 (JP) ..... 2021-047678

(51) Int. Cl.
*F24F 11/84* (2018.01)

(52) U.S. Cl.
CPC ..... *F24F 11/84* (2018.01)

(58) Field of Classification Search
CPC ..... F24F 11/84; F24F 11/36
See application file for complete search history.

(56) References Cited

U.S. PATENT DOCUMENTS

2018/0080692 A1* 3/2018 Honda ..... F25B 13/00
2020/0318840 A1* 10/2020 Wada ..... F24F 11/84

FOREIGN PATENT DOCUMENTS

| | | | |
|---|---|---|---|
| CN | 101737856 | A | 6/2010 |
| CN | 102112814 | A | 6/2011 |
| CN | 110199162 | A | 9/2019 |
| CN | 111033154 | A | 4/2020 |
| CN | 111164360 | A | 5/2020 |
| GB | 2577445 | A | 3/2020 |
| JP | 2004125215 | A | 4/2004 |

(Continued)

OTHER PUBLICATIONS

The PCT Search Report and Written Opinion mailed on Feb. 8, 2022, for PCT Application No. PCT/JP2022/000242, 16 pages.

(Continued)

*Primary Examiner* — Nael N Babaa
(74) *Attorney, Agent, or Firm* — Lee & Hayes, P.C.

(57) ABSTRACT

According to one embodiment, the air conditioner comprises an outdoor unit, an indoor unit, a refrigerant cutoff unit, an airtight state detection unit, a notification unit, and a control unit. The control unit determines a refrigerant cutoff condition for whether or not to urge a flow of the refrigerant flowing into and from the indoor unit to be cut off and, if the refrigerant cutoff condition is satisfied, urges the refrigerant cutoff unit to cut off the flow, and urges the notification unit to notify a detection result of an airtight state of a pipe detected by the airtight state detection unit, in the indoor unit in which the flow of the refrigerant is cut off.

7 Claims, 6 Drawing Sheets

(56) References Cited

FOREIGN PATENT DOCUMENTS

| | | | |
|---|---|---|---|
| JP | 2005241050 | A | 9/2005 |
| JP | 4639451 | B2 | 2/2011 |
| JP | 5813107 | B2 | 11/2015 |
| JP | 2016191503 | A | 11/2016 |
| JP | 2018155426 | A | 10/2018 |
| WO | WO2019/035205 | A1 | 2/2019 |

OTHER PUBLICATIONS

Extended European Search Report, EP Application No. 22774543.7, Jan. 8, 2025, 8 pages.
Chinese Office Action for CN Application No. 202280018464.8, "Air conditioner," Aug. 21, 2025, 8 pages.

* cited by examiner

AIR CONDITIONER

CROSS-REFERENCE TO RELATED APPLICATIONS

This application is a Continuation Application of PCT Application No. PCT/JP2022/000242, filed Jan. 6, 2022 and based upon and claiming the benefit of priority from Japanese Patent Application No. 2021-047678, filed Mar. 22, 2021, the entire contents of all of which are incorporated herein by reference.

FIELD

Embodiments described herein relate generally to an air conditioner using a flammable refrigerant.

BACKGROUND

In recent years, refrigerants used in air conditioners are required to have a low Global Warming Potential (GWP) from the viewpoint of global warming. For example, amendments to the Montreal Protocol, which regulates ozone depleting substances, were adopted in 2016, and phased restrictions on the use of hydrofluorocarbon (HFC) refrigerants started in 2019. In order to cope with this, a number of new low-GWP refrigerants have been proposed by refrigerant manufacturers, but several low-GWP refrigerants have combustibility. When refrigerants having combustibility are used, ensuring safety in the event of refrigerant leakage is essential. Therefore, the Japan Refrigeration and Air Conditioning Industry Association has created standards and guidelines for ensuring the safety of commercial air conditioners and refrigerator systems in the event of slightly flammable refrigerant leakage. These standards and the like indicate, for example, safety measures of using refrigerant leakage detectors and alarms, mechanical ventilators, and refrigerant circuit breakers.

As a conventional safety measure according to this, for example, there is a technique of closing shutoff valves provided in main pipes and branch pipes in a refrigerant branching device to ensure the safety when a refrigerant leakage detection device detects refrigerant leakage. Alternatively, there is a technique of allowing a refrigerant leakage detector to be installed on an outer surface of a ceiling-embedded indoor unit, and cutting off the refrigerant circuit and issuing an alarm to ensure the safety when a leakage is detected.

According to these techniques, however, for example, when a refrigerant leakage occurs in an air conditioner comprising a plurality of indoor units or in a situation where multiple systems of indoor units are installed in the same space, the indoor unit in which the leakage occurs cannot be identified. In contrast, even in such a case, continuing the operations of the indoor units other than the indoor unit in which the leakage occurs is desirable. In particular, for example, a refrigerator system is required to continue the operations as much as possible from the viewpoint of appropriate heat retention control of foods.

The present invention has been accomplished in consideration of this, and its object is to provide an air conditioner capable of reducing the environmental load by suppressing the refrigerant leakage, and of appropriately using the refrigerant even if the refrigerant is flammable. In addition, another object is to provide an air conditioner capable of improving the efficiency of the response work by identifying the indoor unit in which the refrigerant leakage occurs, from among a plurality of indoor units, and performing repairs and maintenance for the identified indoor unit, and of improving the comfortability and the heat retention for foods by continuing the operations of the indoor units in which the refrigerant leakage does not occur.

DETAILED DESCRIPTION

In general, according to one embodiment, the air conditioner comprises an outdoor unit, an indoor unit, a refrigerant cutoff unit, an airtight state detection unit, a notification unit, and a control unit. The outdoor unit includes a compressor which compresses and discharges a sucked refrigerant. At least one indoor unit is provided, allowing a refrigerant to be circulated between the indoor unit and the outdoor unit in a refrigerant circuit formed by a pipe connected to the outdoor unit. The refrigerant cutoff unit cuts off a flow of the refrigerant flowing into the indoor unit and the refrigerant flowing from the indoor unit or cancels cutoff of the flow. The airtight state detection unit detects an airtight state of the pipe in the indoor unit. The notification unit notifies the detection result of the airtight state detection unit. The control unit controls each of operations of the outdoor unit, the indoor unit, the refrigerant cutoff unit, the airtight state detection unit, and the notification unit. Then, the control unit determines a refrigerant cutoff condition for whether or not to urge the flow of the refrigerant flowing into and from the indoor unit to be cut off and, if the refrigerant cutoff condition is satisfied, urges the refrigerant cutoff unit to cut off the flow, and urges the notification unit to notify a detection result of an airtight state of the pipe detected by the airtight state detection unit, in the indoor unit in which the flow of the refrigerant is cut off.

First Embodiment

A first embodiment will be described hereinafter with reference to FIG. 1 and FIG. 2.

Figure 1:
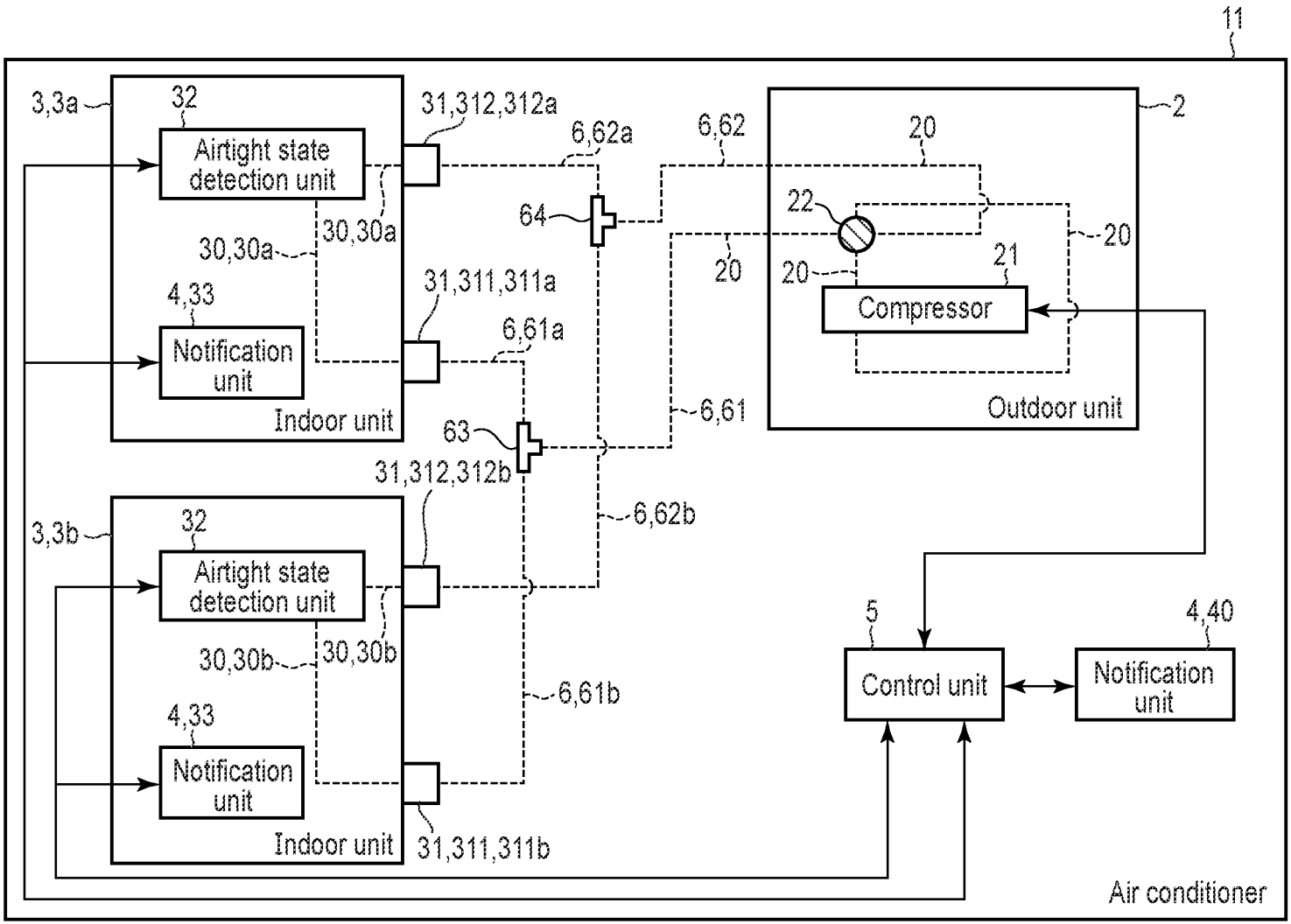
FIG. 1 is a diagram schematically showing a configuration of an air conditioner according to a first embodiment.
Figure 2:
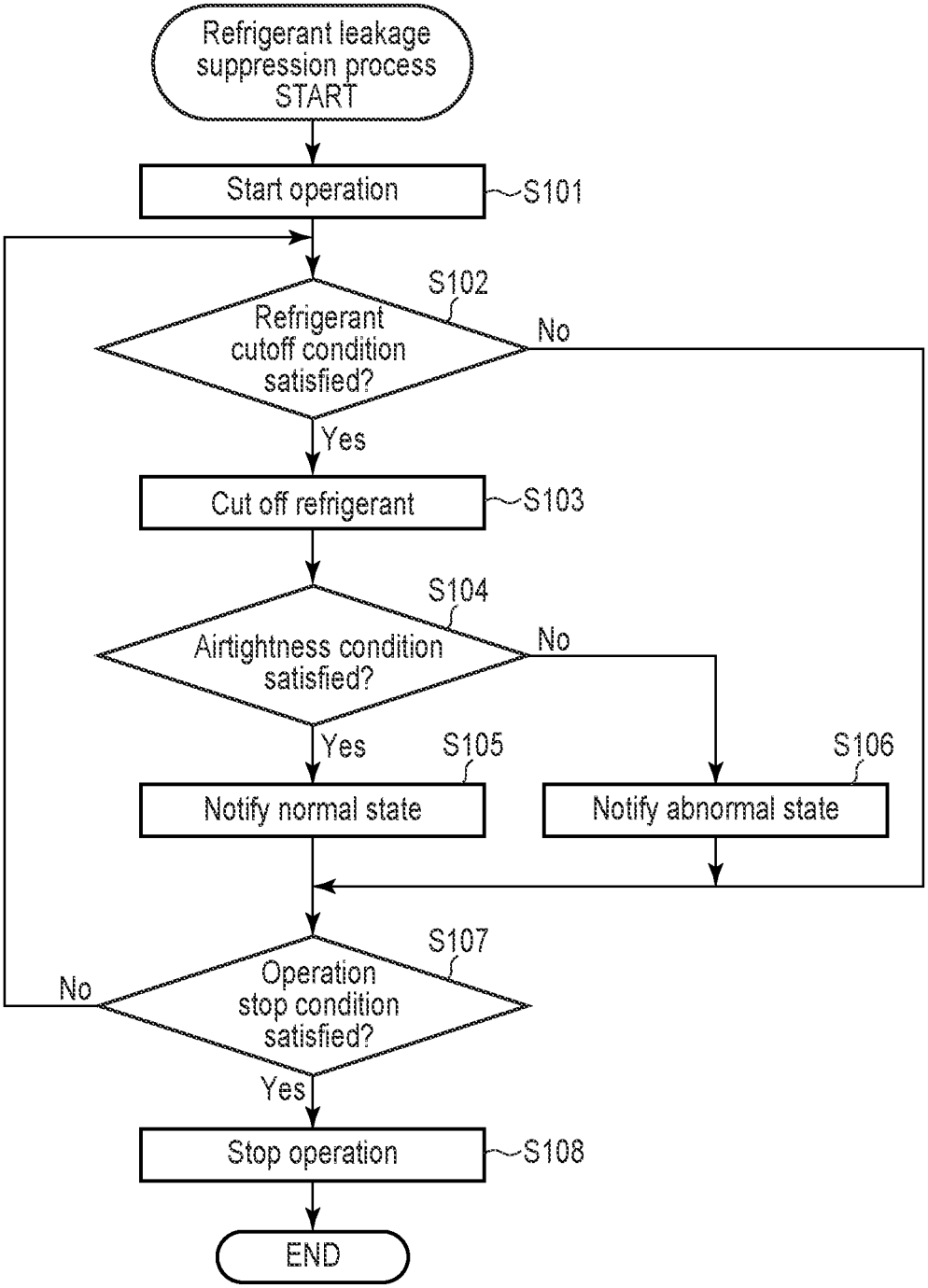
FIG. 2 is a control flowchart showing a refrigerant leakage suppression process in the air conditioner according to the first embodiment.

FIG. 1 is a diagram schematically showing a configuration of an air conditioner 11 according to the present embodiment. The air conditioner 11 indicates, for example, various facilities and devices such as multiple air conditioners for buildings, and refrigerator systems composed of separately installed refrigerators, showcases, and cooling units, which can execute either one or both operations of the cooling operation and the heating operation. Its purpose and application are not particularly limited, but the air conditioner 11 will be described below as, for example, a refrigeration cycle device (refrigerating and air-conditioning device) which comprises a plurality of showcases used for refrigerating and freezing foods or the like as indoor units.

As shown in FIG. 1, the air conditioner 11 comprises an outdoor unit 2, indoor units 3, notification units 4, and a control unit 5. FIG. 1 shows a configuration example of the air conditioner 11 which comprises one outdoor unit 2 and two indoor units 3*a* and 3*b*. However, the number of indoor units 3 may be one or may be three or more.

As shown in FIG. 1, the outdoor unit 2 and the indoor units 3 are connected to each other by pipes 6. The pipes 6 constitute a refrigerant circuit for circulating the refrigerant between the outdoor unit 2 and the indoor units 3, and include a gas pipe 61 for flowing a gas-phase refrigerant and a liquid pipe 62 for flowing a liquid-phase refrigerant. In the configuration example shown in FIG. 1, the gas pipe 61 connected to the outdoor unit 2 is branched into two pipes by a branch pipe 63. One branched gas pipe 61*a* is connected to the indoor unit 3*a* while the other gas pipe 61*b* is connected to the indoor unit 3*b*. Similarly, the liquid pipe 62 connected to the outdoor unit 2 is branched into two parts by a branch pipe 64. One branched liquid pipe 62*a* is connected to the indoor unit 3*a* while the other liquid pipe 62*b* is connected to the indoor unit 3*b*.

The air conditioner 11 can be operated in either a cooling operation or a heating operation. For example, in the cooling operation, the liquid refrigerant flows from the outdoor unit 2 to the indoor unit 3 through the liquid pipes 62, 62*a*, and 62*b* and changes to the gas phase in the indoor units 3. The gas refrigerant that has changed to the gas phase is returned from the indoor units 3 to the outdoor unit 2 through the gas pipes 61*a*, 61*b*, and 61. In contrast, in the heating operation, the gas refrigerant flows from the outdoor unit 2 to the indoor units 3 through the gas pipes 61, 61*a*, and 61*b*, and changes to the liquid phase in the indoor units 3. The liquid refrigerant that has changed to the liquid phase is returned from the indoor units 3 to the outdoor unit 2 through the liquid pipes 62*a*, 62*b*, and 62.

The outdoor unit 2 comprises a compressor 21 and a four-way valve 22 as main elements, as well as an outdoor heat exchanger, an outdoor fan, an expansion valve, an accumulator, a receiver tank, and the like (not shown). The elements other than the outdoor fan are connected by pipes 20 between the gas pipe 61 and the liquid pipe 62 inside the outdoor unit 2. The pipes 20 are parts of the refrigerant circuit with the indoor unit 3. The compressor 21 discharges a high-temperature and high-pressure gas-phase refrigerant from a discharge port, and sucks a low-temperature and low-pressure gas-phase refrigerant from a suction port. The four-way valve 22 guides the refrigerant discharged from the compressor 21 to the indoor units 3 and guides the refrigerant heat-exchanged in the indoor units 3 to the compressor 21.

The indoor unit 3 comprises an indoor heat exchanger and an indoor fan (both not shown) as main elements. The indoor heat exchanger is connected between the gas pipe 61 and the liquid pipe 62 by pipes inside the indoor unit 3. The pipes 30 are parts of the refrigerant circuits with the outdoor unit 2. In the configuration example shown in FIG. 1, the pipe 30*a* connects the gas pipe 61*a* and the liquid pipe 62*a*, inside the indoor unit 3*a*, and the pipe 30*b* connects the gas pipe 61*b* and the liquid pipe 62*b*, inside the indoor unit 3*b*.

In addition, the indoor unit 3 further comprises refrigerant cutoff units 31 and an airtight state detection unit 32 in addition to the above-described main elements.

The refrigerant cutoff units 31 cut off the flow of the refrigerant flowing to the indoor unit 3 and the refrigerant flowing from the indoor unit 3. The refrigerant cutoff units 31 include gas refrigerant cutoff units 311 and liquid refrigerant cutoff units 312. For example, the gas refrigerant cutoff unit 311 is a check valve, and the liquid refrigerant cutoff unit 312 is a solenoid valve. In the configuration example shown in FIG. 1, a gas refrigerant cutoff unit 311*a* is arranged at a connection port between the pipe and the gas pipe 61*a*, and a liquid refrigerant cutoff unit 312*a* is arranged at a connection port between the pipe 30*a* and the liquid pipe 62*a*, in the indoor unit 3*a*. In the indoor unit 3*b*, a gas refrigerant cutoff unit 311*b* is arranged at a connection port between the pipe 30*b* and the gas pipe 61*b*, and a liquid refrigerant cutoff unit 312*b* is arranged at a connection port between the pipe 30*b* and the liquid pipe 62*b*. However, the arrangement of the gas refrigerant cutoff units 311*a* and 311*b* and the liquid refrigerant cutoff units 312*a* and 312*b* is not limited to this. For example, these may be arranged inside the indoor units 3*a* and 3*b*.

The airtight state detection unit 32 detects an airtight state of the pipes 30 in the indoor unit 3. For example, the airtight state detection unit 32 is a pressure sensor which has detection elements arranged in the pipes 30 to detect the pressure of the gas refrigerant in the pipes 30. The pressure sensor, which is the airtight state detection unit 32, supplies the detected pressure value to the control unit 5.

The notification unit 4 notifies the detection results of the airtight state detection unit 32. For example, when it is detected by the airtight state detection unit 32 that the inside of the pipes 30 is not airtight, the notification unit 4 notifies the detection result that the gas refrigerant leaks from the pipes 30 (abnormal state). In addition, when it is detected by the airtight state detection unit 32 that the inside of the pipes 30 is in an airtight state, the notification unit 4 notifies the detection result that the gas refrigerant does not leak from the pipes 30 (normal state). As the notification unit 4, a display lamp, a monitor, a panel, a speaker, or a combination thereof can be applied. For example, in a case of an abnormal state, the notification unit 4 makes the user, worker, or the like (hereinafter referred to as user or the like) thoroughly notified of and call his attention to leakage of a gas refrigerant by red lighting (blinking) of the indicator lamp, the sounding of a warning sound, reproduction and display of a warning message, laser emission or the like. In contrast, in a normal state, the notification unit 4 may perform minimal notification such as turning on a blue warning light, displaying a confirmation message or the like. Incidentally, the notification unit 4 does not need to make any notification in a normal state.

In the configuration example shown in FIG. 1, the notification units 4 include notification units 33 provided in the indoor units 3 and a notification unit 40 provided separately from the outdoor unit 2 or the indoor unit 3. Locations of the notification units 4 may be anywhere as long as they can make the user or the like thoroughly notified of and call his attention to leakage of a gas refrigerant. For example, the notification units 33 may be provided in main bodies, remote controllers or the like, of the indoor units 3, and the notification unit 40 may be provided in a central control room of the air conditioner 11 or the like.

The control unit 5 controls the operations of the outdoor unit 2, the indoor units 3, and the notification units 4. The control unit 5 includes a CPU, a memory, a storage device (nonvolatile memory), an input/output circuit, a timer, and the like, and executes predetermined arithmetic processing. For example, the control unit 5 reads various data by the input/output circuit, executes arithmetic processing by the CPU using programs read from the storage device to the memory, and controls the operations of the outdoor unit 2, the indoor units 3, and the notification units 4, more specifically, these components, based on the processing results. At this time, the control unit 5 transmits and receives control signals and data signals to and from the respective components of the outdoor unit 2, the indoor units 3, and the notification units 4 via wires or in a wireless manner. In the example shown in FIG. 1, the control unit 5 is provided independently of the outdoor unit 2, the indoor units 3, and the notification units 4 but, for example, each of the outdoor unit 2, the indoor units 3, and the notification units 4 may comprise the control unit. In this case, control signals and data signals may be transmitted and received between the control units of the outdoor unit 2, the indoor units 3, and the notification units 4 via wires or in a wireless manner. In addition, the air conditioner 11 may comprise a main control unit which controls each of the control units of the outdoor unit 2, the indoor units 3, and the notification units 4 at a higher level.

The operation control of the outdoor unit 2 and the indoor units 3 which the control unit 5 executes, more specifically, confirmation of leakage of a refrigerant and the operation control of the outdoor unit 2 and the indoor units 3 at the leakage (hereinafter referred to as a refrigerant leakage suppression process) during the operation of the air conditioner 11 comprising the above-described configuration, will be described according to a control flow of the control unit 5. FIG. 2 shows a control flow of the control unit 5 at the refrigerant leakage suppression process.

In the refrigerant leakage suppression process, the air conditioner 11 starts the operation (S101). More specifically, the controller 5 urges each of the operations of the outdoor unit 2 and the indoor units 3 to be started. As a result, for example, the compressor 21, the outdoor fan and the like are appropriately started in the outdoor unit 2, and the indoor fans, the airtight state detection units 32 and the like are appropriately started in the indoor units 3. The operation of the air conditioner 11 is a prerequisite for the refrigerant leakage suppression process. Triggered by the start of operation of the air conditioner 11, the control unit 5 can execute the refrigerant leakage suppression process. Therefore, when the air conditioner 11 is not in operation, the refrigerant leakage suppression process is not executed.

While the air conditioner 11 is in operation, the control unit 5 determines whether or not the refrigerant cutoff condition is satisfied (S102). The refrigerant cutoff condition is a condition for determining whether or not to urge the refrigerant flowing into and from the indoor units 3 to be cut off. The control unit 5 determines whether or not the refrigerant cutoff condition is satisfied for each indoor unit 3, or for each two indoor units 3*a* and 3*b* in the configuration example shown in FIG. 1. In the embodiment, as an example, whether or not the indoor units 3 are thermo off is set as the refrigerant cutoff condition. The control unit 5 determines that the refrigerant cutoff condition is satisfied when the indoor units 3 are thermo off, and determines that the refrigerant cutoff condition is not satisfied when the indoor units 3 are not thermo off. Such a refrigerant cutoff condition corresponding to the thermo off status of the indoor units 3 is hereinafter referred to as a first refrigerant cutoff condition. In this case, it is determined whether or not the first refrigerant cutoff condition is satisfied depending on whether or not every two indoor units 3*a* and 3*b* are thermo off. For example, the indoor units 3 temporarily stop the operation when the temperature of the space to be air-conditioned, such as the inside of the freezer showcase, becomes equal to or lower than the thermo off temperature. The thermo off temperature is, for example, a temperature set by a user or the like, or a temperature obtained by increasing or decreasing the set temperature by a predetermined correction value.

Incidentally, the refrigerant cutoff condition is not limited to the condition (first refrigerant cutoff condition) corresponding to the thermo off status of the indoor units 3. For example, whether or not a predetermined time has elapsed after the start of operation of the indoor units 3, in other words, whether or not the indoor units 3 continuously operate for a predetermined period may be determined as a refrigerant cutoff condition (hereinafter referred to as a second refrigerant cutoff condition). In determining the second refrigerant cutoff condition, the control unit 5 compares the duration of the operation after start of the operation of the indoor units 3 with a predetermined period (hereinafter referred to as a predetermined period). The duration of the operation is measured by, for example, a timer of the control unit 5 that is started in synchronization with the start of operation of the indoor units 3, and is cleared to an initial value (for example, zero) every time the second refrigerant cutoff condition is determined. The predetermined period is the time (threshold value) for which the indoor units 3 are continuously operated until the refrigerant is cut off, and is set with the operation panel of the outdoor unit 2, the remote controllers of the indoor units 3, the operation table of the central control room of the air conditioner 11, or the like by the user or the like. The predetermined period is stored in, for example, a memory of the control unit 5 and used as a parameter when the second refrigerant cutoff condition is determined.

These first refrigerant cutoff condition and second refrigerant cutoff condition may be alternatively applied as refrigerant cutoff conditions or both of them may be applied as a plurality of refrigerant cutoff conditions. For example, the second refrigerant cutoff condition may be determined when the first refrigerant cutoff condition is not satisfied. In this case, even if the indoor units 3 are not thermo off but if the operation continues for the predetermined period, the refrigerant can be cut off. Conversely, the first refrigerant cutoff condition may be determined if the second refrigerant cutoff condition is not satisfied. In this case, if the indoor units 3 which are not continuously operated for a predetermined period are thermo off, the refrigerant can be cut off.

When the refrigerant cutoff condition is satisfied, the controller 5 urges the refrigerant flowing into and from the indoor units 3 to be cut off (S103). For example, when the first refrigerant cutoff condition is satisfied as the refrigerant cutoff condition in S102, the control unit 5 operates the refrigerant cutoff units 31 of the indoor units 3 which are thermo off, and cuts off the refrigerant flowing into and from the indoor units 3 which are thermo off. In the following descriptions, the indoor unit 3 for which the refrigerant cutoff condition is satisfied is appropriately referred to as a target indoor unit 3. In the configuration example shown in FIG. 1, when the indoor unit 3*a* is thermo off and the indoor unit 3*b* is not thermo off, the control unit 5 determines that the target indoor unit 3 is the indoor unit 3*a*, and operates the refrigerant cutoff unit 31*a* to cut off the refrigerant flowing into and from the indoor unit 3*a*. In contrast, since the indoor unit 3*b* is not the target indoor unit 3, the refrigerant cutoff unit 31*b* does not operate, and the refrigerant flowing into and from the indoor unit 3*b* is not cut off. In addition, if the indoor units 3*a* and 3*b* are both thermo off, the control unit 5 determines that both of them are the target indoor units 3, and operates the refrigerant cutoff units 31 of both of them to cut off the refrigerant flowing into and from the indoor units 3*a* and 3*b*. In contrast, if none of them is thermo off, the target indoor unit 3 does not exist and the refrigerant cutoff unit 31 does not operate either.

More specifically, the control unit 5 operates the refrigerant shutoff unit 31 of the target indoor unit 3, i.e., the gas refrigerant cutoff unit 311 and the liquid refrigerant cutoff unit 312 such that inflow and outflow of the gas refrigerant and the liquid refrigerant into and from the target indoor unit 3 are cut off. When the inflow and outflow of the gas refrigerant and the liquid refrigerant are cut off, the air conditioning operation is temporarily stopped in the target indoor unit 3. For example, when the air conditioner 11 is in the cooling operation, the solenoid valve, which is the liquid refrigerant cutoff unit 312, is closed in the target indoor unit 3. As a result, the inflow of the liquid refrigerant to the target indoor unit 3 is cut off. In contrast, the check valve, which is the gas refrigerant cutoff unit 311, cuts off the outflow of the gas refrigerant from the target indoor unit 3 and stops the inflow (backflow) of the gas refrigerant to the target indoor unit 3 by cutting off the inflow of the liquid refrigerant to the target indoor unit 3. The control unit 5 indirectly controls the operation of the check valve (gas refrigerant cutoff unit 311) by controlling the operation of the solenoid valve (liquid refrigerant cutoff unit 312).

In addition, for example, when the second refrigerant cutoff condition is satisfied as the refrigerant cutoff condition (Yes in S102), the control unit 5 urges the refrigerant flowing into and from the indoor unit (target indoor unit) 3 which is continuously operated for the predetermined period (S103) to be cut off. In the configuration example shown in FIG. 1, when the indoor unit 3*a* is operated for the predetermined period and the indoor unit 3*b* is not operated for the predetermined period, the control unit 5 determines that the target indoor unit 3 is the indoor unit 3*a* and operates the refrigerant cutoff unit 31*a* to cut off the refrigerant flowing into and from the indoor unit 3*a*. In contrast, since the indoor unit 3*b* is not the target indoor unit 3, the refrigerant cutoff unit 31*b* does not operate, and the refrigerant flowing into and from the indoor unit 3*b* is not cut off. If the indoor units 3*a* and 3*b* are both operated for the predetermined period, the control unit 5 determines that both of them are the target indoor units 3, and operates the refrigerant cutoff units 31 of both of them to cut off the refrigerant flowing into and from the indoor units 3*a* and 3*b*. In contrast, if both of them are not operated for the predetermined period, the target indoor unit 3 does not exist and the refrigerant cutoff unit 31 does not operate either.

Next, when urging the refrigerant flowing into and from the target indoor unit 3 to be cut off, the control unit 5 determines the airtightness condition (S104). The airtightness condition is a condition for determining whether or not the pipes 30 are in an airtight state in the target indoor unit 3. In determining the airtightness condition, the control unit 5 acquires the detection result of the airtight state of the pipes 30 in the target indoor unit 3 from the airtight state detection unit 32. In the present embodiment, the controller 5 acquires a pressure value of the gas refrigerant in the pipes 30 from a pressure sensor, which is the airtight state detection unit 32. Next, the control unit 5 compares the acquired pressure value of the gas refrigerant with a predetermined threshold value (hereinafter referred to as a first threshold value). For example, when the pressure value exceeds the first threshold value, the control unit 5 determines that the airtightness condition is satisfied. In contrast, when the pressure value is less than or equal to the first threshold value, the control unit 5 determines that the airtightness condition is not satisfied. The first threshold value is a pressure value (appropriate value) at which the pipe 30 is kept in an airtight state without leakage of the gas refrigerant, and is set in advance in accordance with the performance of the indoor unit 3, and the like. However, the first threshold value may be a pressure range having a certain numerical width. The first threshold value is stored in, for example, a storage device of the control unit 5, read to the memory and used as a parameter when the airtightness condition is determined.

If the airtightness condition is satisfied (Yes in S104), it is determined by the airtight state detection unit 32 that the inside of the pipe 30 is in an airtight state, and the control unit 5 determines that the state corresponds to a state (normal state) in which the gas refrigerant does not leak from the pipe and urges the notification unit 4 to notify the normal state (S105). As a result, for example, the blue lighting of the indicator lamp, display of a confirmation message and the like are performed. Incidentally, in a normal state, no particular problem occurs even if the user or the like is not notified, and the notification can be omitted in this case.

In contrast, if the airtightness condition is not satisfied (No in S104), it is detected by the airtight state detection unit 32 that the inside of the pipe 30 is not in the airtight state, and the control unit 5 detects that the state corresponds to a state (abnormal state) in which the gas refrigerant leaks from the pipe 30 and urges the notification unit 4 to notify the abnormal state (S106). As a result, for example, the red lighting (blinking) of the indicator lamp, the sounding of the warning sound, the reproduction and display of a warning message, the laser emission, or the like is performed.

Incidentally, the control unit 5 may urge the notification unit 4 to continue the predetermined notification until the user or the like is informed of the normal state or the abnormal state. However, the user or the like may be able to manually stop the notification by the notification unit 4 after informing.

When a predetermined notification is performed by the notification unit 4, the control unit determines the operation stop condition of the air conditioner 11 (S107). In addition, even when the refrigerant cutoff condition is not satisfied in S102, the control unit 5 determines the operation stop condition of the air conditioner 11 (S107).

The operation stop condition is a condition for determining whether or not to stop the operation of the air conditioner 11, and is determined according to, for example, whether the control unit 5 has received a signal indicating the operation stop of the air conditioner 11. The signal indicating the operation stop is transmitted when, for example, the user or the like selects the operation stop from setting units (not shown) of the outdoor unit 2 or the indoor units 3. The setting unit is composed of, for example, an operation panel, switches, buttons, a display for displaying, and the like.

If the operation stop condition is not satisfied (No in S107), the control unit 5 determines the refrigerant cutoff condition again (S102), and selectively repeats the subsequent processes (S103 to S106) according to the determination result.

In contrast, if the operation stop condition is satisfied (Yes in S107), the control unit 5 stops the operation of the air conditioner 11 (S108).

In other words, while the air conditioner 11 is in operation, a series of refrigerant leakage suppression processes is repeated. Then, when the operation of the air conditioner 11 is stopped, the series of refrigerant leakage suppression processes is also ended.

According to such a refrigerant leakage suppression process, when the refrigerant cutoff condition is satisfied, for example, when the indoor unit 3 is thermo off or the operation is continued for a predetermined time, it is determined whether or not the indoor unit 3 is in an airtight state after cutting off inflow and outflow of the refrigerant in the indoor unit 3 (target indoor unit 3). As a result, the occurrence of refrigerant leakage in the indoor unit 3 can be periodically and appropriately confirmed, and the occurrence of refrigerant leakage can be specified. Therefore, the refrigerant leakage can be prevented in advance and to reduce the environmental load can be reduced. In addition, when the refrigerant leaks in the indoor unit 3, the notification unit 4 can immediately notify this. As a result, the user or the like can be notified quickly that the refrigerant leaks from the indoor unit 3. In addition, it is possible to immediately arrange for, for example, a repair and maintenance company after suppressing the refrigerant leakage in advance. As a result, the efficiency of repair maintenance work for the refrigerant leakage can be improved.

For example, when R32, which has a lower global warming potential (GWP) than R410A or R407C, is used as the refrigerant, R32 has slight flammability. According to the present embodiment, the refrigerant having such combustibility can be properly used since the refrigerant leakage can be appropriately suppressed.

In the above-described embodiment, the occurrence of the refrigerant leakage is determined based on whether or not the pipe 30 is in an airtight state in the indoor unit 3 to suppress the refrigerant leakage in advance, but the determination means is not limited to this. An embodiment of determining the occurrence of the refrigerant leakage by another determination means will be described below as a second embodiment. A basic configuration of an air conditioner in the second embodiment is the same as that of the air conditioner 11 according to the first embodiment shown in FIG. 1. Constituent elements different from those of the air conditioner 11 will be described in detail below. Constituent elements that are the same as or similar to those of the air conditioner 11 are denoted by the same reference numerals in the drawings, and descriptions thereof are omitted or simplified.

Second Embodiment

Figure 3:
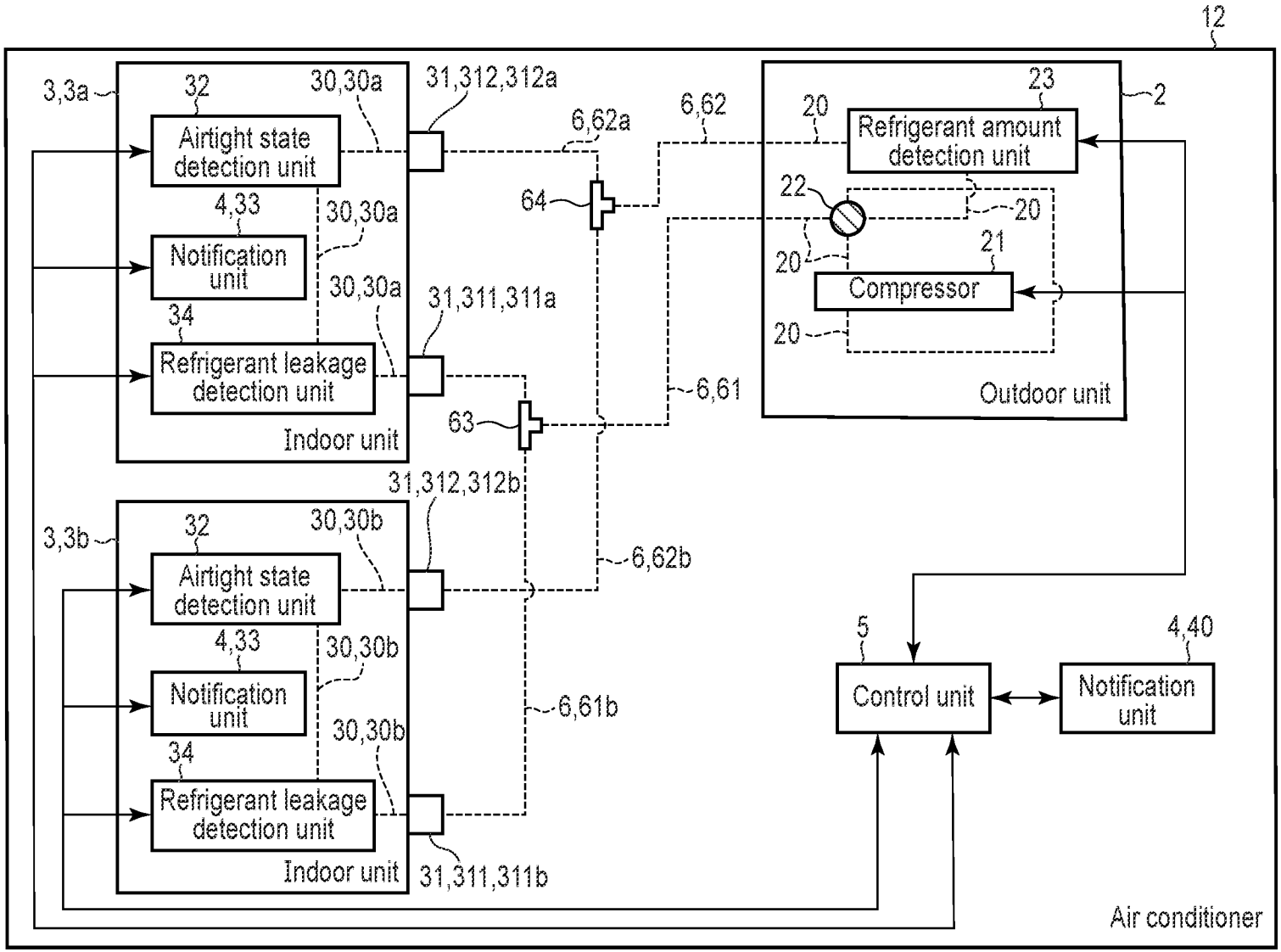
FIG. 3 is a diagram schematically showing a configuration of an air conditioner according to a second embodiment.

FIG. 3 is a diagram schematically showing a configuration of an air conditioner 12 according to the present embodiment. As shown in FIG. 3, the air conditioner 12 comprises an outdoor unit 2, indoor units 3, a notification unit 4, and a control unit 5. Configurations of the notification unit 4 and the control unit 5 are the same as those of the air conditioner 11 (FIG. 1) according to the first embodiment.

The outdoor unit 2 further comprises a refrigerant amount detection unit 23 in addition to main elements such as a compressor 21, a four-way valve 22, and an outdoor heat exchanger, an outdoor fan, an expansion valve, an accumulator, and a receiver tank which are not shown, and the like.

The refrigerant amount detection unit 23 determines whether or not the amount of the refrigerant circulating between the outdoor unit 2 and the indoor units 3, i.e., in the refrigerant circuit, is appropriate. For example, the refrigerant amount detection unit 23 is a sensor that detects the pressure and temperature of the refrigerant in the pipe 20 by arranging a detection element in the refrigerant circuit, more specifically in the pipe 20 of the outdoor unit 2. Alternatively, the refrigerant amount detection unit 23 is a gauge which is arranged in the receiver tank of the outdoor unit 2 to detect a liquid surface position of the liquid refrigerant stored in the receiver tank. A pressure sensor, a temperature sensor, a storage gauge, and the like, which are the refrigerant amount detection unit 23, supply the detected values to the control unit 5.

The indoor unit 3 further comprises a refrigerant cutoff unit 31, an airtight state detection unit 32, a notification unit 33, and a refrigerant leakage detection unit 34 in addition to main elements such as an indoor heat exchanger and an indoor fan (both not shown).

The refrigerant leakage detection unit 34 detects refrigerant leakage from the pipes 30 in the indoor unit 3. For example, the refrigerant leakage detection unit 34 is a semiconductor or infrared gas sensor which has a detection element arranged near the pipes 30 to react to the gas refrigerant leaking from the pipes 30. When reacting to the gas refrigerant leaking from the pipes 30, the refrigerant leakage detection unit 34 outputs a signal (hereinafter referred to as a reaction signal) indicating this to the control unit 5. In contrast, when not reacting to the gas refrigerant leaking from the pipes 30, the refrigerant leakage detection unit 34 does not output a reaction signal to the control unit 5. Alternatively, in this case, the refrigerant leakage detection unit 34 may output a signal indicating no reaction (hereinafter referred to as a non-reaction signal) to the control unit 5. In other words, the refrigerant leakage detection unit 34 directly detects the refrigerant leakage from the pipes 30 in the indoor unit 3.

Figure 4:
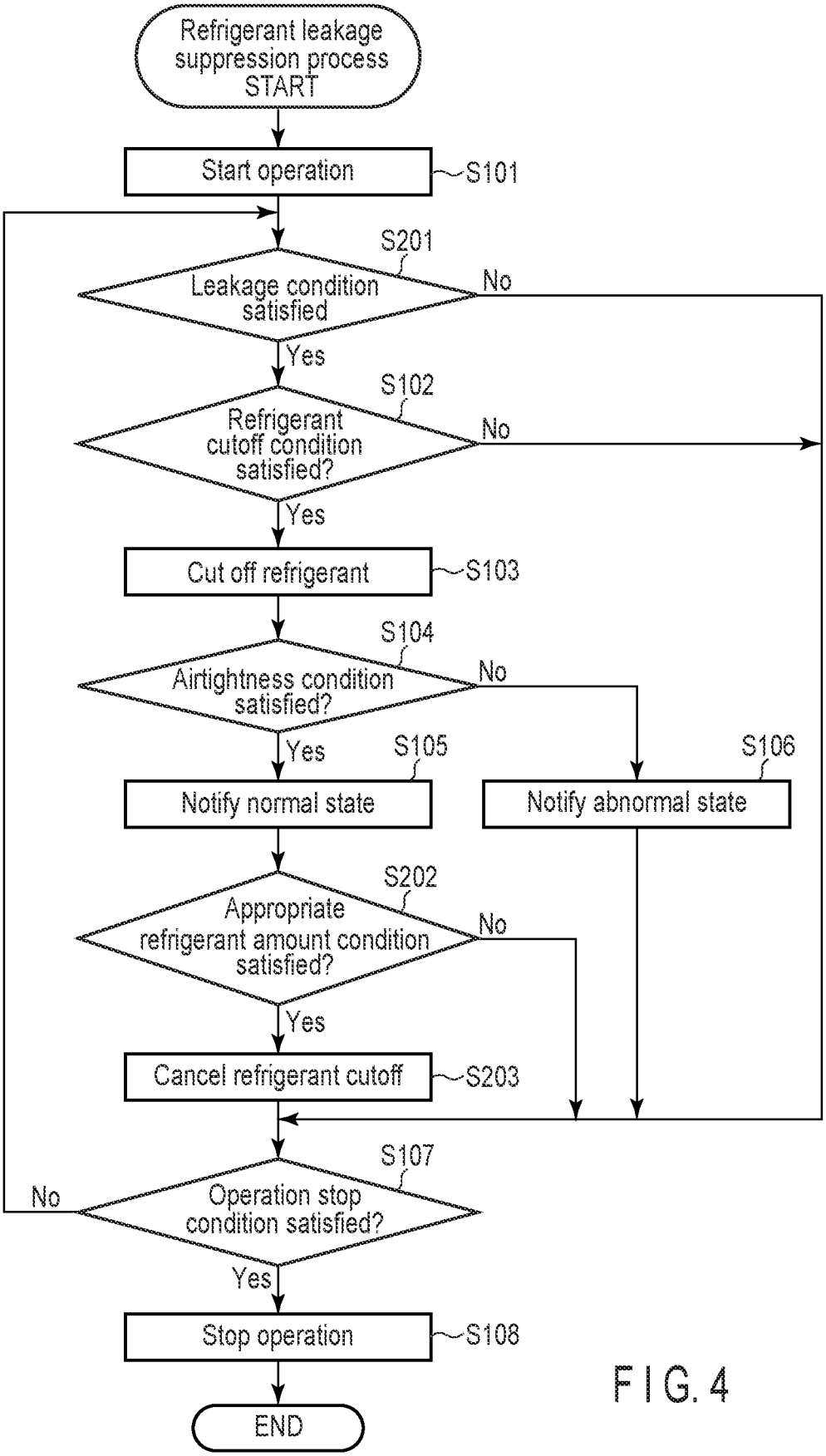
FIG. 4 is a control flowchart showing a refrigerant leakage suppression process in the air conditioner according to the second embodiment.

FIG. 4 shows a control flow of the control unit 5 during the refrigerant leakage suppression process in the present embodiment. Incidentally, the control flow of the refrigerant leakage suppression process of the present embodiment shown in FIG. 4 is a flow obtained by adding or changing a part of the control flow (FIG. 2) of the first embodiment to the control specific to the present embodiment. Therefore, the controls equivalent to those of the above-described first embodiment are denoted by the same step numbers and the descriptions thereof are omitted, and controls specific to the present embodiment will be described in detail below.

When the air conditioner 12 starts the operation (S101), the control unit 5 determines a refrigerant leakage condition (S201). The refrigerant leakage condition is a condition for determining whether the refrigerant leaks from the pipes 30 in the indoor units 3. In determining the refrigerant leakage condition, the control unit 5 acquires the detection results of the occurrence of the refrigerant leakage from the pipes 30 in the indoor units 3, from the refrigerant leakage detection units 34. In the present embodiment, the control unit 5 acquires the occurrence of the reaction to the gas refrigerant leaking from the pipes 30, from the gas sensors, which are the refrigerant leakage detection units 34. For example, when receiving the reaction signal from the refrigerant leakage detection unit 34, the control unit 5 determines that the refrigerant leakage condition is satisfied. In contrast, when not receiving the reaction signal from the refrigerant leakage detection unit 34 or receiving the non-reaction signal from the refrigerant leakage detection unit 34, the control unit determines that the refrigerant leakage condition is not satisfied. The control unit 5 determines satisfaction of the refrigerant leakage condition for each of the two indoor units 3*a* and 3*b*.

If the refrigerant leakage condition is not satisfied (No in S201), the control unit 5 determines an operation stop condition of the air conditioner 1 (S107).

In contrast, if the refrigerant leakage condition is satisfied (Yes in S201), the control unit determines the refrigerant cutoff condition (S102). The refrigerant cutoff condition in this case (hereinafter referred to as a third refrigerant cutoff condition) is a determination condition in a state in which the refrigerant leakage condition is satisfied and, if the refrigerant leakage condition is satisfied in the target indoor unit 3, the control unit 5 determines that the third refrigerant cutoff condition is also satisfied. In contrast, if the refrigerant leakage condition is not satisfied in the target indoor unit 3, the control unit 5 determines that the third refrigerant cutoff condition is not satisfied either. Then, the control unit 5 selectively executes subsequent processes (S103 to S106) according to the determination result of the third refrigerant cutoff condition.

Therefore, when the refrigerant leakage condition is satisfied in the target indoor unit 3, the control unit 5 immediately urges the refrigerant flowing into and from the target indoor unit 3 to be cut off regardless of occurrence of thermo off and the duration of the operation of the target indoor unit 3 (S103). Incidentally, if the airtightness condition is satisfied in S104, notifying the notification unit 4 of the normal state (S105) can be omitted. In this case, both the refrigerant leakage condition and the refrigerant cutoff condition are satisfied, and the refrigerant flowing into and from the target indoor unit 3 is cut off. If the airtightness condition is satisfied in this state, the inside of the pipes 30 of the target indoor unit 3 is in an airtight state, and the target indoor unit 3 corresponds to a state (normal state) in which the gas refrigerant does not leak from the pipes 30.

For this reason, the control unit 5 determines an appropriate refrigerant amount condition (S202). The appropriate refrigerant amount condition is a condition for determining whether or not the amount of the refrigerant circulated between the outdoor unit 2 and the indoor units 3 including the target indoor unit 3 is appropriate. In determining the appropriate refrigerant amount condition, the control unit 5 acquires the detection result of the amount of the refrigerant circulating between the outdoor unit 2 and the indoor units 3 from the refrigerant amount detection unit 23. In the present embodiment, the control unit 5 acquires values of the pressure and temperature of the refrigerant in the pipes 20 of the outdoor unit 2 from the pressure sensor and the temperature sensor, which are the refrigerant amount detection unit 23. Alternatively, the control unit 5 acquires the liquid surface position of the liquid-phase refrigerant stored in the receiver tank from the storage gauge, which is the refrigerant amount detection unit 23. Next, for example, the control unit 5 compares the acquired pressure value, temperature value, or liquid level position of the refrigerant with a predetermined threshold value (hereinafter referred to as a second threshold value). The second threshold value is a pressure value, a temperature value, or a liquid surface position in a state in which the refrigerant is kept at an appropriate amount without shortage in the refrigerant circuit, and is set in advance according to the performance of the outdoor unit 2, and the like. The second threshold value is stored in, for example, a storage device of the control unit 5, and read to the memory and used as a parameter when the airtightness condition is determined. If the pressure value, the temperature value, or the liquid surface position of the refrigerant is within a proper range as a result of comparison with the second threshold value, the control unit 5 determines that the appropriate refrigerant amount condition is satisfied. In contrast, if the pressure value, the temperature value, or the liquid surface position of the refrigerant is out of the proper range, the control unit 5 determines that the appropriate refrigerant amount condition is not satisfied.

If the appropriate refrigerant amount condition is satisfied (Yes in S202), the control unit 5 cancels the cutoff of the refrigerant flowing into and from the target indoor unit 3 (S203). In this case, the control unit 5 determines that the amount of refrigerant circulating between the outdoor unit 2 and the indoor units 3 including the target indoor unit 3 is appropriate, cancels the cutoff of the refrigerant flowing into and from the target indoor unit 3, and urges the inflow and outflow of the refrigerant into and from the target indoor unit 3 to be resumed. As a result, the suspended air conditioning operation of the target indoor unit 3 is resumed. In this example, the control unit 5 sequentially cancels the cutoff of the refrigerant flowing into and from all the target indoor units 3. For example, when both of the two indoor units 3*a* and 3*b* are the target indoor units 3, the control unit 5 sequentially cancels the cutoff of the refrigerant in these target indoor units 3 and urges the air conditioning operation to be resumed.

When canceling the cutoff of the refrigerant flowing into and from the target indoor unit 3, the control unit 5 determines the operation stop condition of the air conditioner 12 (S107). In addition, even when the appropriate refrigerant amount condition is not satisfied in S202, the control unit 5 determines the operation stop condition of the air conditioner 12 (S107).

If the operation stop condition is not satisfied, the control unit 5 determines the refrigerant leakage condition again (S201), and selectively repeats subsequent processes (S102 to S106, S202, and S203) according to the determination result.

In contrast, if the operation stop condition is satisfied, the control unit 5 stops the operation of the air conditioner 12 (S108).

In other words, while the air conditioner 12 is in operation, a series of refrigerant leakage suppression processes is repeated. Then, when the operation of the air conditioner 12 is stopped, the series of refrigerant leakage suppression processes is also ended.

According to the present embodiment executing such refrigerant leakage suppression processes, the following advantages are achieved in addition to the advantages of the first embodiment described above. That is, the accuracy of confirmation and specific determination of the occurrence of the refrigerant leakage in the indoor unit (target indoor unit) 3 can be improved by determining the refrigerant leakage condition and the airtightness condition in two stages. In addition, if the appropriate refrigerant amount condition is satisfied even in the indoor units 3 in which the inflow and outflow of the refrigerant are cut off and the air conditioning operation is temporarily suspended by satisfying the airtightness condition, the air conditioning operation of the indoor units 3 can be sequentially resumed. Therefore, the operation of the indoor units 3 other than the indoor unit 3 in which the refrigerant leakage occurs can be continued, and the comfortability and the heat retention of food in the space to be air-conditioned in the air conditioner 12 can be improved.

In the first and second embodiments described above, when the refrigerant cutoff condition is satisfied, the refrigerant cutoff unit 31 (gas refrigerant cutoff unit 311 and liquid refrigerant cutoff unit 312) of the target indoor unit 3 is operated to cut off the inflow and outflow of the gas refrigerant and the liquid refrigerant in the target indoor unit 3. At this time, a pump-down operation may be executed in the air conditioner. An embodiment in which such a pump-down operation is executed will be described below as a third embodiment. A basic configuration of an air conditioner in the third embodiment is similar to that of the air conditioner 11 of the first embodiment shown in FIG. 1 and the air conditioner 12 of the second embodiment shown in FIG. 3. Therefore, constituent elements different from those of the air conditioners 11 and 12 will be described in detail below. Constituent elements that are the same as or similar to those of the air conditioners 11 and 12 are denoted by the same reference numerals in the drawings, and descriptions thereof are omitted or simplified.

Third Embodiment

Figure 5:
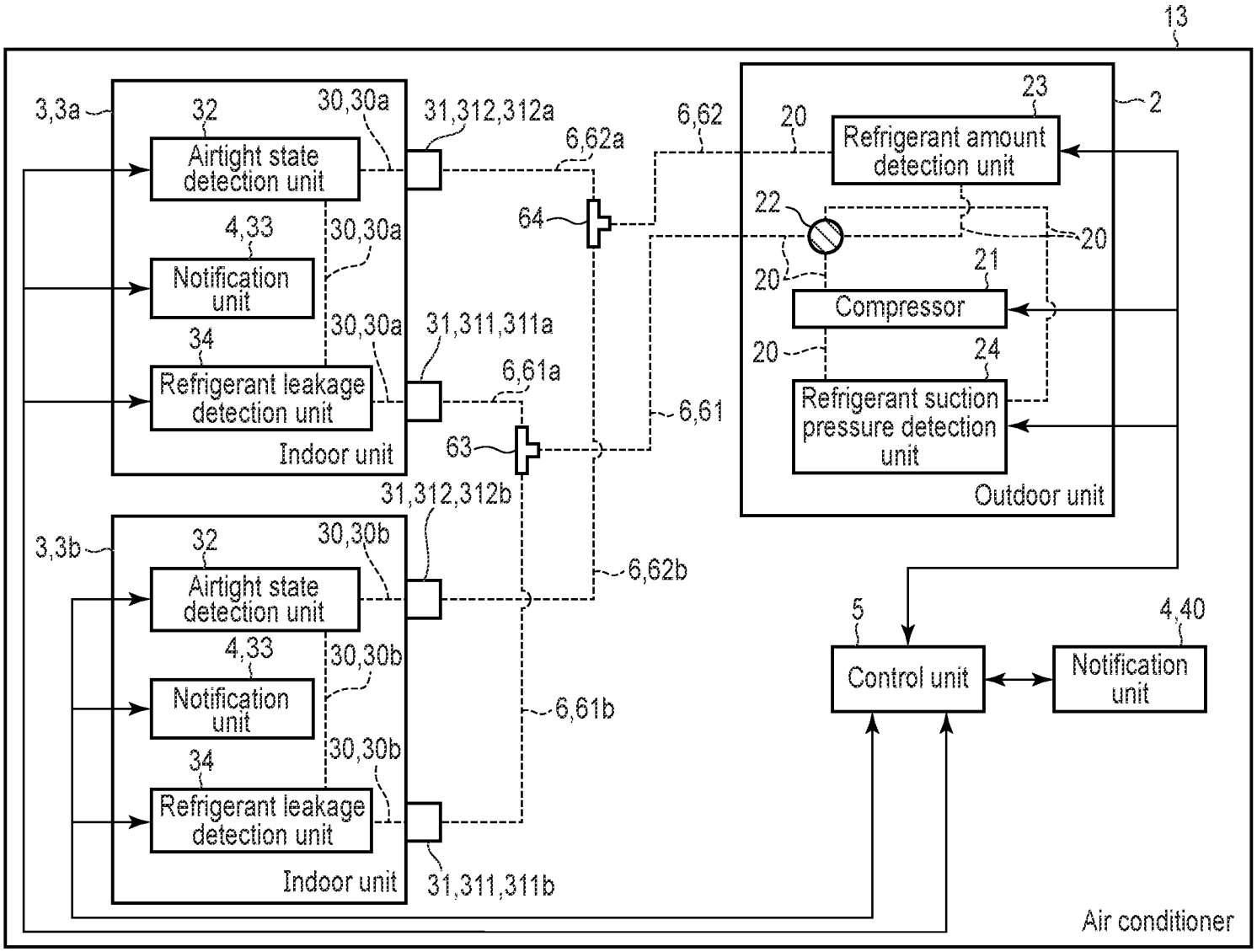
FIG. 5 is a diagram schematically showing a configuration of an air conditioner according to a third embodiment.

FIG. 5 is a diagram schematically showing a configuration of an air conditioner 13 according to the present embodiment. As shown in FIG. 5, the air conditioner 12 comprises an outdoor unit 2, indoor units 3, a notification unit 4, and a control unit 5. Configurations of the notification unit 4 and the control unit 5 are the same as those of the air conditioner 11 (FIG. 1) according to the first embodiment and the air conditioner 12 (FIG. 3) according to the second embodiment.

The outdoor unit 2 comprises a refrigerant amount detection unit 23 and further comprises a refrigerant suction pressure detection unit 24 in addition to main elements such as a compressor 21, a four-way valve 22, and an outdoor heat exchanger, an outdoor fan, an expansion valve, an accumulator, and a receiver tank which are not shown, and the like.

The refrigerant suction pressure detection unit 24 detects a suction pressure of a refrigerant sucked into the compressor 21. For example, the refrigerant suction pressure detection unit 24 is a pressure sensor in which a detection element is arranged in a pipe connecting an outlet of an accumulator and a suction port of the compressor 21 in the outdoor unit 2 to detect a pressure of a gas refrigerant in the pipe. A pressure sensor, which is the refrigerant suction pressure detection unit 24, supplies the detected pressure value to the control unit 5.

The indoor unit 3 comprises a refrigerant cutoff unit 31, an airtight state detection unit 32, a notification unit 33, and a refrigerant leakage detection unit 34 in addition to main elements such as an indoor heat exchanger and an indoor fan (both not shown). A configuration of the indoor unit 3 is the same as that of the air conditioner 12 (FIG. 3) according to the second embodiment.

Figure 6:
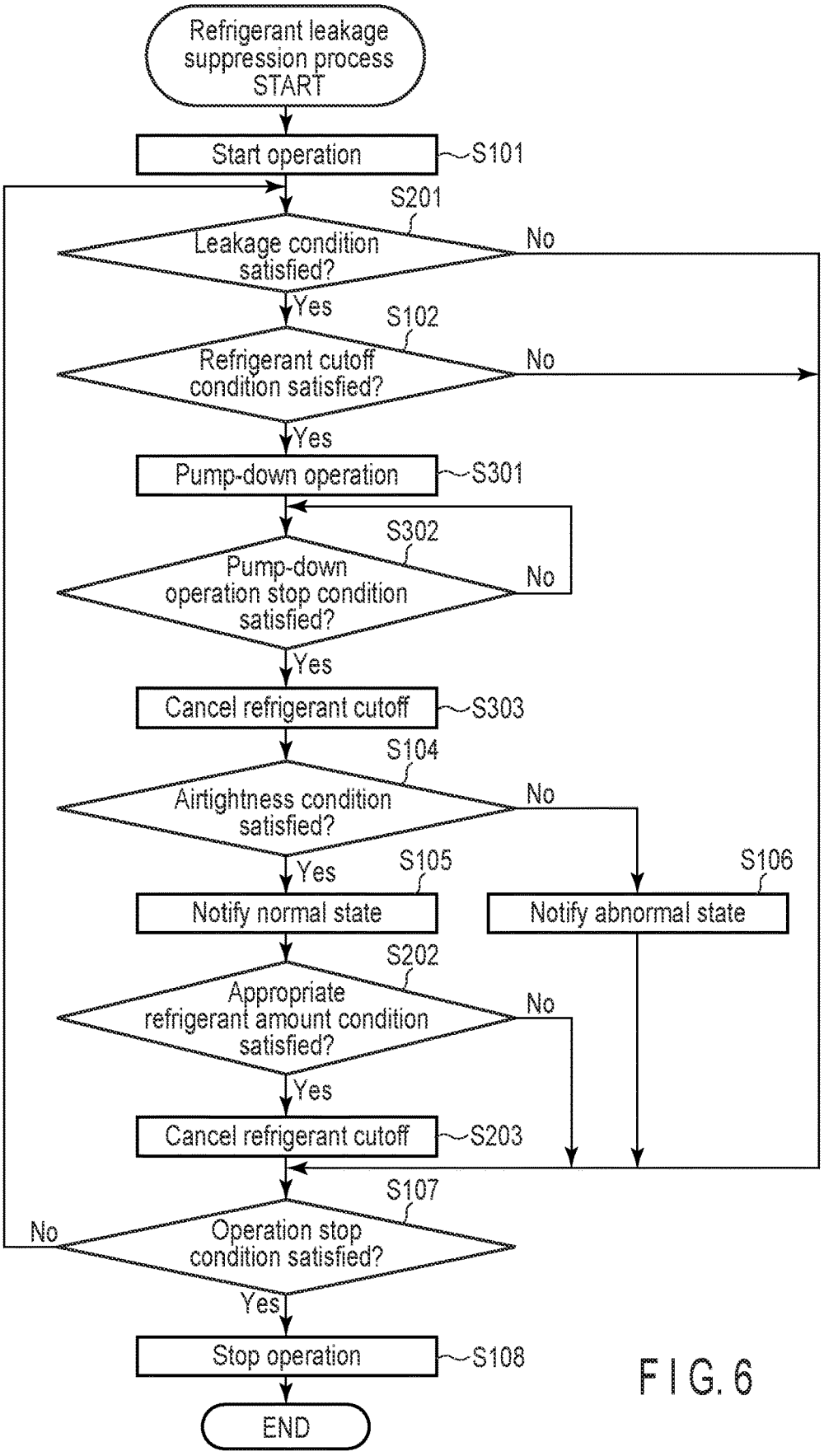
FIG. 6 is a control flowchart showing a refrigerant leakage suppression process in the air conditioner according to the third embodiment.

FIG. 6 shows a control flow of the control unit 5 during the refrigerant leakage suppression process in the present embodiment. Incidentally, the control flow of the refrigerant leakage suppression process of the present embodiment shown in FIG. 6 is a flow obtained by adding or changing a part of the control flow (FIG. 4) of the second embodiment to the control specific to the present embodiment. Therefore, the controls equivalent to those of the above-described first and second embodiments are denoted by the same step numbers and the descriptions thereof are omitted, and controls specific to the present embodiment will be described in detail below.

When the air conditioner 13 starts the operation (S101), the control unit 5 determines the refrigerant leakage condition (S201) and, if the refrigerant leakage condition is satisfied, determines the refrigerant cutoff condition (S102). The refrigerant cutoff condition in this example (hereinafter referred to as a fourth refrigerant cutoff condition) is a determination condition for executing a pump-down operation in the air conditioner 13 which will be described later. Therefore, if the refrigerant leakage condition is satisfied in any of the indoor units 3, the control unit 5 determines that the fourth refrigerant cutoff condition is also satisfied. In contrast, if the refrigerant leakage condition is not satisfied in any of the indoor units 3, the control unit 5 determines that the fourth refrigerant cutoff condition is not satisfied.

If the refrigerant cutoff condition is satisfied (Yes in S102), the control unit 5 executes the pump-down operation (S301). In this case, the control unit 5 operates the refrigerant cutoff unit 31 of each indoor unit 3, i.e., the gas refrigerant cutoff unit 311 and the liquid refrigerant cutoff unit 312, and urges inflow and outflow of the gas refrigerant and the liquid refrigerant into and from these indoor units 3 to be cut off. For example, when the air conditioner 13 is in the cooling operation, the solenoid valve, which is the liquid refrigerant cutoff unit 312, is closed in each indoor unit 3. As a result, the inflow of the liquid refrigerant to each indoor unit 3 is cut off. The control unit 5 continues the operation of the compressor 21 in this state, and causes the refrigerant on the indoor unit 3 side to be sucked to the outdoor unit 2 side. At this time, the check valve, which is the gas refrigerant cutoff unit 311, cuts off the outflow of the gas refrigerant from each indoor unit 3 and stops the inflow (backflow) of the gas refrigerant to each indoor unit 3 by cutting off the inflow of the liquid refrigerant to each indoor unit 3. As a result, the controller 5 seals the refrigerant of the refrigerant circuit in the outdoor unit 2.

When executing the pump-down operation, the control unit 5 determines a pump-down operation stop condition (S302). The pump-down operation stop condition is a condition for determining whether or not to stop the pump-down operation in the air conditioner 13. In determining the pump-down operation stop condition, the control unit 5 acquires the detection result of the suction pressure of the refrigerant sucked into the compressor 21, from the refrigerant suction pressure detection unit 24. Next, the control unit 5 compares the acquired refrigerant suction pressure value with a predetermined threshold value (hereinafter referred to as a third threshold value). The third threshold value is a pressure value or pressure range in a state in which the refrigerant of the refrigerant circuit is sealed in the outdoor unit 2, and is set in advance according to the performance of the compressor 21, and the like. The third threshold value is stored in, for example, the storage device of the control unit 5, and read to the memory and used as a parameter when the pump-down operation stop condition is determined. For example, if the refrigerant suction pressure is within the range of the third threshold value in comparison with the third threshold value, the control unit 5 determines that the pump-down operation stop condition is satisfied. In contrast, if the refrigerant suction pressure is out of the range of the third threshold value, the control unit 5 determines that the pump-down operation stop condition is not satisfied.

Incidentally, the pump-down operation stop condition is not limited to such conditions according to the suction pressure. For example, whether or not a predetermined time has elapsed after the start of the pump-down operation may be the pump-down operation stop condition. In this case, the controller 5 compares the duration of the pump-down operation with a predetermined time. The duration of the pump-down operation is cleared to an initial value (for example, zero) every time the pump-down operation stop condition is determined. The predetermined time is the duration of the operation of the compressor 21 required for the refrigerant of the refrigerant circuit to be sealed in the outdoor unit 2 (hereinafter referred to as a fourth threshold value), and is set in advance according to the performance of the compressor 21, and the like. The fourth threshold value is stored in, for example, the storage device of the control unit 5, and read to the memory and used as a parameter when the pump-down operation stop condition is determined.

When the pump-down operation stop condition is satisfied, the control unit 5 cancels the cutoff of the refrigerant flowing into and from each indoor unit 3 (S303). In this example, the control unit 5 repeats determination of the condition until the pump-down operation stop condition is satisfied, in other words, until the cutoff of the refrigerant flowing into and from each indoor unit 3 can be canceled.

When canceling the cutoff of the refrigerant flowing into and from each indoor unit 3, the control unit 5 determines the airtightness condition (S104), and repeats subsequent processes (S105 to S106, S202, and S203) depending on the determination result until the operation stop condition is satisfied (S108).

In other words, while the air conditioner 13 is in operation, a series of refrigerant leakage suppression processes is repeated. Then, when the operation of the air conditioner 13 is stopped, the series of refrigerant leakage suppression processes is also ended.

According to the present embodiment executing such refrigerant leakage suppression processes, the following advantages are achieved in addition to the advantages of the first and second embodiments described above. In other words, if the refrigerant leakage condition is satisfied in any of the indoor units 3 (S201), the refrigerant in the refrigerant circuit can be sealed in the outdoor unit 2 and the refrigerant leakage can be minimized by executing the pump-down operation (S301). After that, in the present embodiment, the airtightness condition is determined in the same manner as that in the second embodiment. Therefore, if the appropriate refrigerant amount condition is satisfied even in the indoor units 3 in which the inflow and outflow of the refrigerant are cut off and the air conditioning operation is temporarily suspended by satisfying the airtightness condition, the air conditioning operation of the indoor units 3 can be sequentially resumed. As a result, the operation of the indoor units 3 other than the indoor unit 3 in which the refrigerant leakage occurs can be continued, and the comfortability and the heat retention of food in the space to be air-conditioned in the air conditioner 13 can be improved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An air conditioner comprising:

an outdoor unit including a compressor which compresses and discharges a sucked refrigerant;

at least one indoor unit allowing a refrigerant to be circulated between the indoor unit and the outdoor unit in a refrigerant circuit formed by a pipe connected to the outdoor unit;

a refrigerant cutoff unit cutting off a flow of the refrigerant flowing into the indoor unit and the refrigerant flowing from the indoor unit or canceling cutoff of the flow;

an airtight state detection unit detecting an airtight state of the pipe in the indoor unit;

a notification unit notifying a detection result of the airtight state detection unit; and a control unit controlling each of operations of the outdoor unit, the indoor unit, the refrigerant cutoff unit, the airtight state detection unit, and the notification unit, the control unit determining a refrigerant cutoff condition for whether or not to urge the flow of the refrigerant flowing into and from the indoor unit to be cut off and, if the refrigerant cutoff condition is satisfied, urging the refrigerant cutoff unit to cut off the flow, and urging the notification unit to notify a detection result of an airtight state of the pipe detected by the airtight state detection unit, in the indoor unit in which the flow of the refrigerant is cut off, wherein the indoor unit is thermo off at a desired thermo off temperature, and the control unit determines a first refrigerant cutoff condition which is a condition for determining whether or not the indoor unit is thermo off, as the refrigerant cutoff condition.

2. The air conditioner of claim 1, wherein the control unit determines a second refrigerant cutoff condition which is a condition for determining whether or not the indoor unit continuously operates for a predetermined period, as the refrigerant cutoff condition and, if the second refrigerant cutoff condition is satisfied, urges the refrigerant cutoff unit to cut off the flow of the refrigerant flowing into and from the indoor unit at an interval of the predetermined period.

3. An air conditioner comprising:

an outdoor unit including a compressor which compresses and discharges a sucked refrigerant;

at least one indoor unit allowing a refrigerant to be circulated between the indoor unit and the outdoor unit in a refrigerant circuit formed by a pipe connected to the outdoor unit;

a refrigerant cutoff unit cutting off a flow of the refrigerant flowing into the indoor unit and the refrigerant flowing from the indoor unit or canceling cutoff of the flow;

an airtight state detection unit detecting an airtight state of the pipe in the indoor unit;

a notification unit notifying a detection result of the airtight state detection unit;

a refrigerant leakage detection unit detecting a leakage of the refrigerant from the pipe in the indoor unit;

a refrigerant suction pressure detection unit detecting a suction pressure of the refrigerant sucked into the compressor; and a control unit controlling each of operations of the outdoor unit, the indoor unit, the refrigerant cutoff unit, the airtight state detection unit, and the notification unit, the control unit determining a refrigerant cutoff condition for whether or not to urge the flow of the refrigerant flowing into and from the indoor unit to be cut off and, if the refrigerant cutoff condition is satisfied, urging the refrigerant cutoff unit to cut off the flow, and urging the notification unit to notify a detection result of an airtight state of the pipe detected by the airtight state detection unit, in the indoor unit in which the flow of the refrigerant is cut off, wherein the control unit determines a first refrigerant cutoff condition which is a condition for determining whether or not the indoor unit is thermo off, as the refrigerant cutoff condition, a second refrigerant cutoff condition which is a condition for determining whether or not the indoor unit continuously operates for a predetermined period, as the refrigerant cutoff condition, and a third refrigerant cutoff condition which is a condition for determining whether or not the refrigerant leakage detection unit detects the leakage of the refrigerant, as the refrigerant cutoff condition, and if the third refrigerant cutoff condition is satisfied and the suction pressure of the refrigerant detected by the refrigerant suction pressure detection unit is within a predetermined range, the control unit urges the refrigerant cutoff unit to cut off the flow of the refrigerant flowing into and from the indoor unit for a predetermined period, urges the refrigerant cutoff unit to cancel cutoff of the flow of the refrigerant flowing into and from the indoor unit after the predetermined period has elapsed, and urges the airtight state detection unit to detect an airtight state of the pipe in the indoor unit in which the cutoff of the flow of the refrigerant is canceled.

4. The air conditioner of claim 1, wherein if the airtight state detection unit detects the airtight state in the indoor unit in which the flow of the refrigerant is cut off, the control unit urges the refrigerant cutoff unit to cancel the cutoff of the flow of the refrigerant flowing into and from the indoor unit in the airtight state.

5. The air conditioner of claim 4, further comprising:

a refrigerant amount detection unit detecting whether or not an amount of the refrigerant circulated between the outdoor unit and the indoor unit is within a predetermined range, wherein the control unit urges the refrigerant cutoff unit to cancel the cutoff of the flow of the refrigerant flowing into and from the indoor unit in the airtight state, under a condition that the refrigerant amount detection unit detects that the amount of the refrigerant is within the predetermined range.

6. The air conditioner of claim 2, wherein if the airtight state detection unit detects the airtight state in the indoor unit in which the flow of the refrigerant is cut off, the control unit urges the refrigerant cutoff unit to cancel the cutoff of the flow of the refrigerant flowing into and from the indoor unit in the airtight state.

7. The air conditioner of claim 3, wherein if the airtight state detection unit detects the airtight state in the indoor unit in which the flow of the refrigerant is cut off, the control unit urges the refrigerant cutoff unit to cancel the cutoff of the flow of the refrigerant flowing into and from the indoor unit in the airtight state.

* * * * *